United States Patent [19]

Chen et al.

[11] Patent Number: 5,031,793

[45] Date of Patent: Jul. 16, 1991

[54] LITTER BIN

[76] Inventors: Wen-Kuei Chen, 547, Hsi Ta Road; Kuei-Tsai Lai, 5, Lane 623, Sec. 1, Huang Fu Road, both of Hsin Chu, Taiwan

[21] Appl. No.: 587,265

[22] Filed: Sep. 24, 1990

[51] Int. Cl.[5] ..... B65D 25/16

[52] U.S. Cl. ..... 220/407; 220/571; 220/87.1; 220/908; 220/625; 220/531

[58] Field of Search ..... 220/407, 87.1, 908, 220/625, 627, 531, 571, 572, 87.2

[56] References Cited

U.S. PATENT DOCUMENTS

| | | | |
|---|---|---|---|
| 629,710 | 7/1899 | Canedy | 220/87.1 |
| 733,002 | 7/1903 | Burgess | 220/531 |
| 751,433 | 2/1904 | Kennedy | 220/625 |
| 1,131,847 | 3/1915 | Lucas | 220/627 |
| 1,283,710 | 11/1918 | Evenson | 220/531 |
| 1,331,428 | 2/1920 | Glud | 220/87.1 |
| 3,451,453 | 6/1969 | Heck | 220/407 |
| 3,875,871 | 4/1975 | Thornton et al. | 220/531 |
| 4,349,123 | 9/1982 | Yang | 220/908 |
| 4,953,744 | 9/1990 | Koyama | 220/908 |
| 4,955,505 | 9/1990 | Battaglia | 220/407 |

FOREIGN PATENT DOCUMENTS

| | | | |
|---|---|---|---|
| 3701363 | 9/1988 | Fed. Rep. of Germany | 220/908 |
| 162602 | 6/1989 | Japan | 220/407 |
| 213366 | 5/1967 | Sweden | 220/908 |
| 12566 | of 1891 | United Kingdom | 220/87.1 |
| 1204203 | 9/1970 | United Kingdom | 220/407 |
| 1478824 | 7/1977 | United Kingdom | 220/407 |

*Primary Examiner*—Stephen Marcus
*Assistant Examiner*—S. Castellano
*Attorney, Agent, or Firm*—Alfred Lei

[57] ABSTRACT

This invention relates to a litter bin and in particular to one including a housing which has two lugs at an inner vertical side and a flange at the opposite side. The housing further has a flap pivotally connected with the lugs and supported by the flange. Three recesses are provided on inner bottom side of the housing for receiving deodorant, a roll of plastic bags and a waste water container.

1 Claim, 4 Drawing Sheets

LITTER BIN

BACKGROUND OF THE INVENTION

It is found that the prior art litter bin (see FIG. 1) is simply a container for receiving litter and the waste water thereof often makes the bin very dirty thereby contaminating the environment.

Therefore, it is an object of the present invention to provide a litter bin which may obviate and mitigate the above-mentioned drawbacks.

SUMMARY OF THE INVENTION

This invention relates to an improved litter bin.

It is the primary object of the present invention to provide a litter bin which may be free from dirt and may keep the environment clean.

It is another object of the present invention to provide a litter bin which may disguise or absorb odor of the litter.

It is still another object of the present invention to provide a litter bin which may cause a new plastic bag to be automatically arranged in the bin when the plastic bag full with litter is lifted to be thrown away.

It is a further object of the present invention to provide a litter bin which may let the waste water of the litter drip down into a waste water container.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
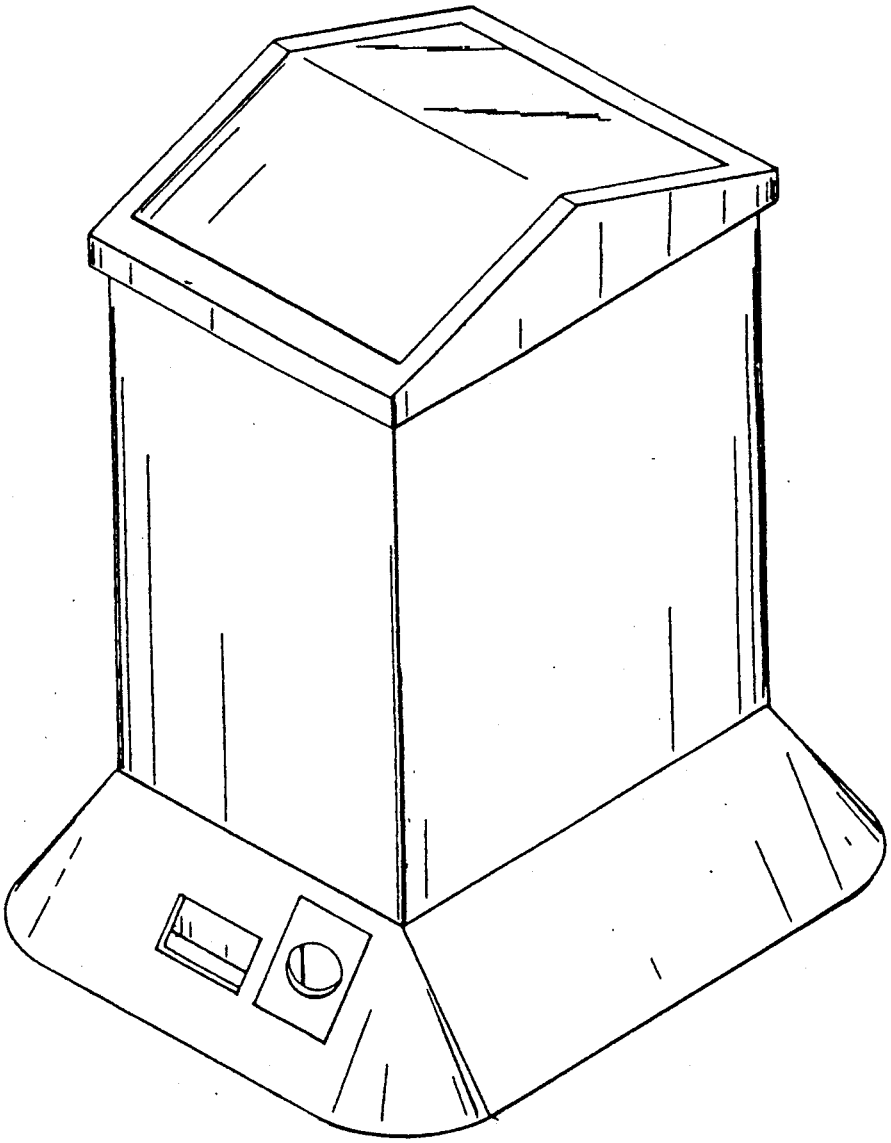
PRIOR ART FIG. 1
FIG. 1 is a perspective view of a litter bin according to the present invention.
Figure 2:
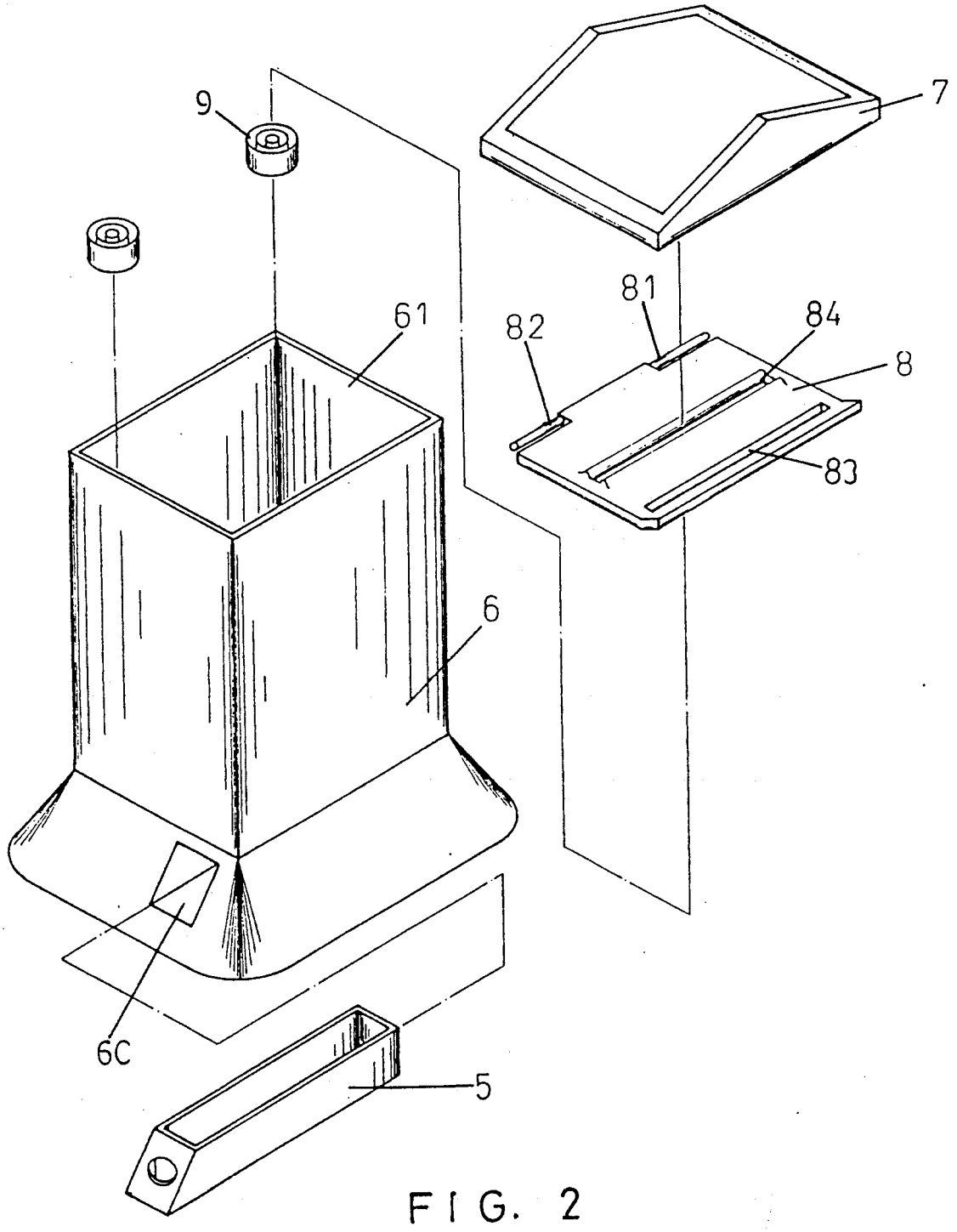
FIG. 2 is an exploded view of the litter bin.
Figure 3:
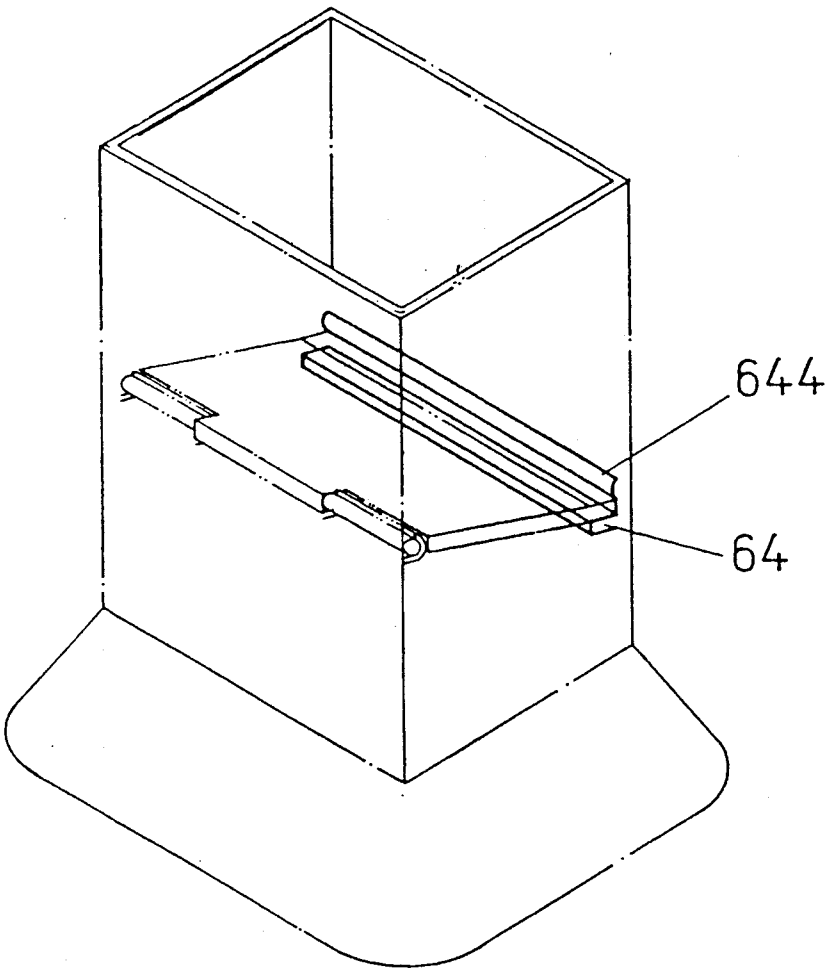
FIG. 3 shows the lugs of the litter bin.
Figure 3:
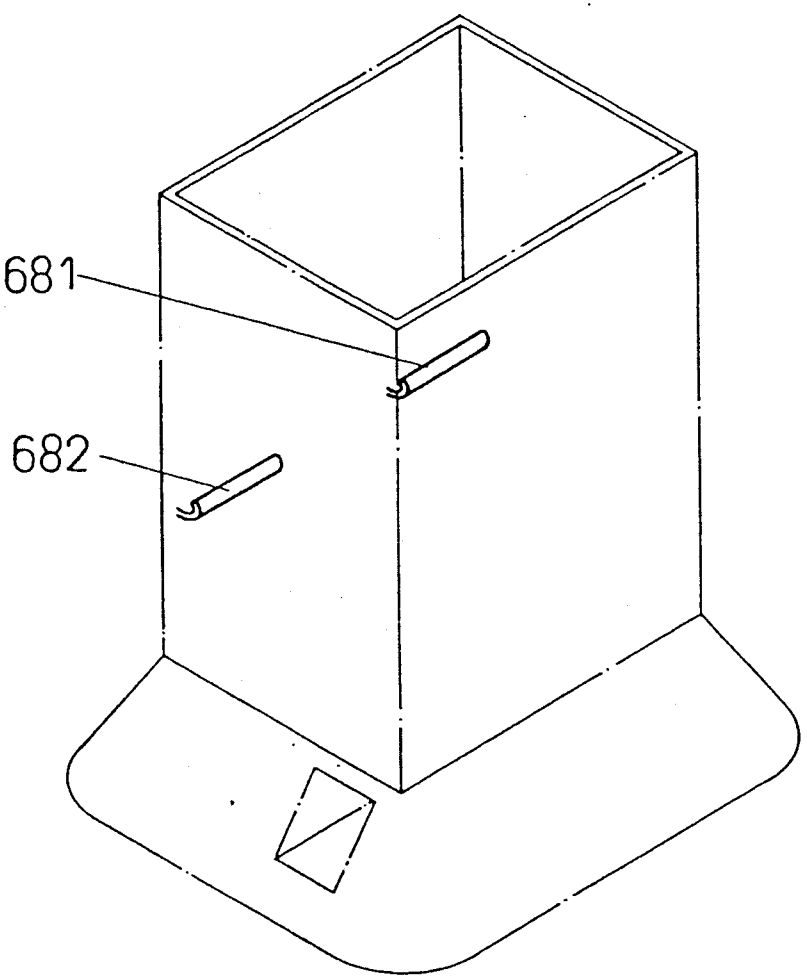

With reference to the drawings and in particular to FIGS. 1 and 2 thereof, the litter bin according to the present invention mainly comprises a housing 6, a movable flap 8 and a waste water container 5. The inner bottom of the housing 6 is provided with three recesses 6A, 6B and 6C separated by two partitions 21 and 22.

The recess 6C extends downwardly through the housing 6 and a waste water container 5 is inserted therein so as to receive the waste water dripping down from the litter in the housing 6. Two lugs 681 and 682 are provided on the inner vertical side of the housing 6 and a flange 64 is formed on the opposite position of the lug 681 and located at a higher position. The flap 8 is provided with two pins 81 and 82 for engaging with the lugs 681 and 682 so that the other side of the flap 8 is supported by the flange 64 and may be turned upwards. Above the flange 64 there is a protuberance 644 so that the flap 8 may be snap-fitted on the flange 64 to form a lower space 62. The recess 6A is used to receive deodorants 9 for disguising or absorbing odors of the litter, while the recess 6B is used to receive a roll of plastic bag for receiving litter.

Figures 4, 5, 6:
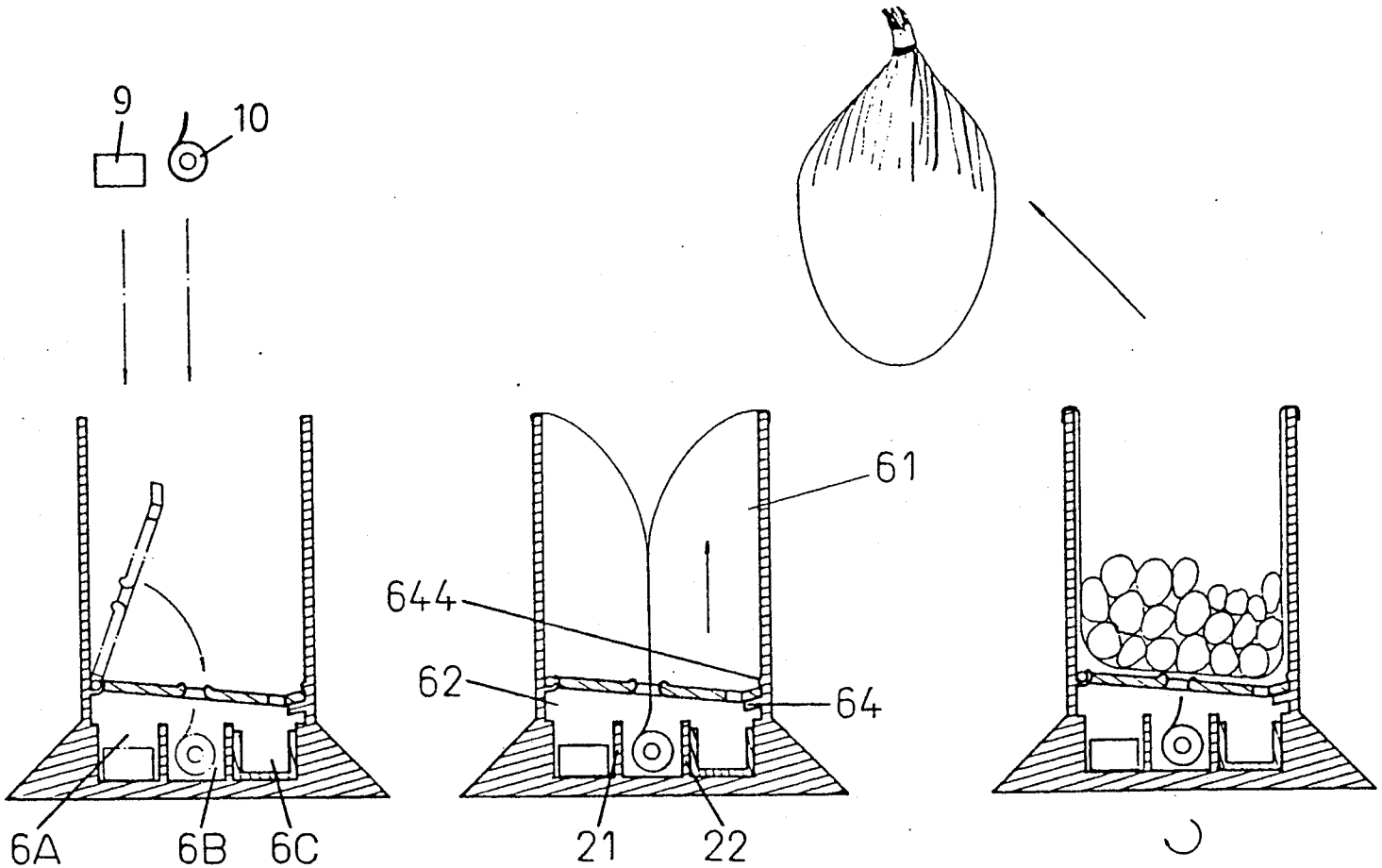
FIG. 4 is a sectional view showing the way to place a deodorant and a roll of plastic bag into the litter bin.
FIG. 5 is a sectional view illustrating the way to dispose a plastic bag into the litter bin.
FIG. 6 is a working view of the litter bin.

In use, simply turn over the flap 8 and place the deodorants 9 in recess 6A and a roll of plastic bag 10 in recess 6B. Then, pull an edge of the roll 10 upwardly through the slit 84 of the flap 8 as illustrated in FIG. 4 and lower the flap 8 on the flange 64. As may be seen in FIG. 5, the waste water (if any) of the litter will drip down into the waste water container 5 through the elongated opening 83 of the flap 8. When the plastic bag full of litter is lifted to be thrown away, a new plastic bag will be automatically arranged in the bin.

Although the present invention has been described with a certain degree of particularity, it is understood that the present disclosure is made by way of example only and that numerous changes in the detail of construction of the combination and arrangement of parts may be resorted to without departing from the spirit and scope of the invention as hereinafter claimed.

We claim:

1. A litter bin comprising:

a housing having two lugs at an inner vertical side and a flange at the opposite side;

a waste water container;

three recesses provided on inner bottom side of said housing and divided by two partitions, first one of the recesses passing through one side of said housing for receiving said waste water container, second one of the recesses being designed for receiving a roll of plastic bags, third one of the recesses being used to receive deodorant for disguising or absorbing odor;

a flap pivotally connected with the lugs of said housing and normally supported by the flange thereof; and a protuberance provided above the flange of said housing for keeping said flap in position.

* * * * *